US011490726B1

(12) United States Patent
Zhang et al.

(10) Patent No.: US 11,490,726 B1
(45) Date of Patent: Nov. 8, 2022

(54) FOLDING TABLE STAND, FOLDING TABLE, AND METHOD FOR ASSEMBLING THE SAME

(71) Applicant: ZHEJIANG JIECANG LINEAR MOTION TECHNOLOGY CO., LTD., Zhejiang (CN)

(72) Inventors: Donghang Zhang, Zhejiang (CN); Xiangjun Shi, Zhejiang (CN)

(73) Assignee: ZHEJIANG JIECANG LINEAR MOTION TECHNOLOGY CO., LTD., Zhejiang (CN)

( * ) Notice: Subject to any disclaimer, the term of this patent is extended or adjusted under 35 U.S.C. 154(b) by 0 days.

(21) Appl. No.: 17/366,004

(22) Filed: Jul. 1, 2021

(51) Int. Cl.
*A47B 9/00* (2006.01)
*A47B 13/02* (2006.01)
*A47B 3/08* (2006.01)

(52) U.S. Cl.
CPC ..... *A47B 9/00* (2013.01); *A47B 3/08* (2013.01); *A47B 13/02* (2013.01); *A47B 2200/0056* (2013.01)

(58) Field of Classification Search
CPC .... A47B 9/00; A47B 9/20; A47B 9/02; A47B 9/08; A47B 13/02; A47B 2200/0056
See application file for complete search history.

(56) References Cited

U.S. PATENT DOCUMENTS 9,271,567 B2 3/2016 Wu
2015/0282605 A1* 10/2015 Wu ..... A47B 9/00 248/188.2
2018/0110324 A1* 4/2018 Keller ..... A47B 9/14
2018/0242728 A1* 8/2018 Hansen ..... A47B 3/0818
2019/0082823 A1* 3/2019 Applegate ..... A47B 1/08
2019/0125072 A1* 5/2019 Tseng ..... A47B 9/20
2020/0154881 A1* 5/2020 Applegate ..... A47B 3/0815
2021/0015250 A1* 1/2021 Chu ..... A47B 17/02
2021/0100355 A1* 4/2021 Jorgensen ..... A47B 9/20

FOREIGN PATENT DOCUMENTS

CN 108813946 11/2018
WO WO-2022099881 A1 * 5/2022

* cited by examiner

*Primary Examiner* — Daniel J Rohrhoff
(74) *Attorney, Agent, or Firm* — JCIPRNET

(57) ABSTRACT

Disclosed is an electric height adjustable folding table, including: a table stand, the table stand including a crossbeam, two ends of the crossbeam being respectively mounted with an electric height adjustable upright; wherein a positioning elongated slot is provided on the crossbeam, and the electric height adjustable upright includes a positioning axle via which the electric height adjustable upright performs rotative and sliding movements in the positioning elongated slot; and when the electric height adjustable upright is at a first position, the positioning axle is at a proximal end of the positioning elongated slot and maintains a spread-out angle with respect to the crossbeam; and when the electric height adjustable upright is at a second position, the positioning axle slides to a distal end of the positioning elongated slot, and meanwhile the positioning axle rotates in the positioning elongated slot towards the center of the crossbeam, thereby implementing folded reception.

14 Claims, 3 Drawing Sheets

FOLDING TABLE STAND, FOLDING TABLE, AND METHOD FOR ASSEMBLING THE SAME

BACKGROUND

Technical Field

Embodiments of the present disclosure generally relate to electric height adjustable tables, and more particularly relate to an electric height adjustable folding table and a method for assembling the same.

Description of Related Art

Tables, including office desks, are indispensable in daily life and work. Many jobs are currently done by sitting before computers. However, sedentariness poses a hidden health risk to office staff. To address this issue, height adjustable tables have emerged in the market and become increasing popular. The height adjustable tables not only offer users options of sitting work or standing work, but also enable them to set a desired height.

Conventional electric height adjustable tables generally have a structure comprising: a tabletop board, a crossbeam, and an electric height adjustable upright, the crossbeam being fixed to the underside of the tabletop board, the electric height adjustable upright being mounted to the crossbeam in a substantially vertical manner. Such electric height adjustable tables, after being assembled, are bulky and inconvenient for packaging and shipment. Therefore, upon out of factory or upon shipment, it is a usual practice for manufacturers or distributors to separate crossbeams from electric height adjustable uprights, leaving the users to assemble them. Although such practices are convenient for packaging and shipment, they are inconvenient for users to assemble.

To tackle that problem, some manufacturers have made their efforts in improving electric height adjustable tables. For example, the Chinese Patent No. CN108813946A, which discloses a foldable electric height adjustable table, and the U.S. Pat. No. 9,271,567. They both disclose articulating the electric height adjustable uprights with the crossbeam, such that the electric height adjustable uprights and the crossbeam are folded to reduce space occupation before packaging and shipment, and upon assembly, the users just unfold the electric height adjustable uprights and fasten them to the crossbeam. This not only facilitates packaging and shipment to some extent, but also facilitates user assembly.

However, the above schemes still have some problems in practical use. For example, as shown in FIG. 5 of the U.S. Pat. No. 9,271,567, the overall folded length of the two electric lift rights is generally greater than the overall length of the crossbeam. As such, the two folded electric height adjustable uprights are partially overlapped. The overlap portion increases the overall thickness of the crossbeam with the folded electric height adjustable uprights, rendering an undesired accommodation effect.

SUMMARY

To overcome the above or more drawbacks, embodiments of the present disclosure provide an electric height adjustable folding table and a method for assembling the electric height adjustable folding table, which not only facilitate assembly but also facilitate packaging and shipment of parts.

Embodiments of the present disclosure provide the following technical solutions:

an electric height adjustable folding table, comprising: a table stand, the table stand including a crossbeam, two ends of the crossbeam being respectively mounted with an electric height adjustable upright; wherein a positioning elongated slot is provided on the crossbeam, and the electric height adjustable upright includes a positioning axle via which the electric height adjustable upright performs rotative and sliding movements in the positioning elongated slot; and wherein when the electric height adjustable upright is at a first position, the positioning axle is at a proximal end of the positioning elongated slot and maintains a spread-out angle with respect to the crossbeam; and when the electric height adjustable upright is at a second position, the positioning axle slides to a distal end of the positioning elongated slot, and meanwhile the positioning axle rotates in the positioning elongated slot towards the center of the crossbeam, thereby implementing folded reception.

The present disclosure has the following beneficial effects:

The height adjustable table in the present disclosure is provided with a positioning elongated slot on the crossbeam, wherein the positioning axle on the electric height adjustable upright is oriented in the positioning elongated slot. In the present disclosure, the positioning axle performs a relative rotative movement and a relative sliding movement in the positioning elongated slot. The relative rotative movement is mainly configured to fold between the electric height adjustable upright and the crossbeam; while the relative sliding movement is configured to move the folded electric height adjustable upright to the distal end portion of the crossbeam to the utmost extent, i.e., moving to the distal end of the positioning elongated slot, such that in the folded state (i.e., at the second position), the overlap portion between two folded electric height adjustable uprights is reduced or even eliminated. In this way, the overall thickness of the folded electric height adjustable uprights is reduced, facilitating packaging and shipment.

Upon assembly, what is done by the user is just rotating to unfold the electric height adjustable uprights and meanwhile move the positioning axle of each electric height adjustable upright from the distal end to the proximal end of the positioning elongated slot, which eliminates the trouble of repositioning and facilitates assembly.

In one embodiment, the positioning elongated slot is an inclined slot, the distance between the proximal end of the inclined slot and the top of the crossbeam being L1, and the distance between the distal end of the inclined slot and the top of the crossbeam being L2, wherein L1>L2.

In one embodiment, the inclined angle of the positioning elongated slot ranges from 1° to 45°.

In one embodiment, the crossbeam includes an accommodation space for mounting the electric height adjustable upright, the positioning elongated slot being respectively provided on two opposite internal sidewalls of the accommodation space, and the positioning axle being respectively provided on two opposite external sidewalls of the electric height adjustable upright.

In one embodiment, the crossbeam includes two crossbars arranged in parallel; the positioning elongated slot is provided on the internal sidewall of each crossbar; and an assembly hole runs between the external sidewall of the crossbar and the positioning elongated slot, thereby facilitating assembly of the positioning axle.

In one embodiment, the electric height adjustable upright comprises a housing and an upright portion; the positioning axle is a tightening screw mounted to the external sidewall of the housing, or the positioning axle is a pin that is plug-fitted to the housing, or the positioning axle is a protruding platform formed on the housing.

In one embodiment, the electric height adjustable upright comprises a side lug, wherein when the electric height adjustable upright is at the first position, the lug is fixed to the crossbeam via a fastener.

In one embodiment, the crossbeam comprises two crossbars arranged in parallel; the crossbars are hollow tubes; end portions of each crossbar are respectively mounted with a side board frame; the side board frame comprises a side board and a plugboard; the plugboard is inserted into the corresponding hollow tube; and the side board and the plugboard are simultaneously fixed to the corresponding hollow tube by a fastener.

In one embodiment, the crossbeam is a telescopic crossbeam.

In one embodiment, the electric height adjustable upright and the crossbeam are pre-assembled to form a preassembled module.

In one embodiment, the preassembled module further comprises a tabletop board, wherein the electric height adjustable upright and the crossbeam are fixed to the tabletop board to jointly form a preassembled module.

Further, embodiments of the present disclosure provide a method for assembling an electric height adjustable table, wherein the electric height adjustable table refers to the electric height adjustable folding table in any of the technical solutions above, and the assembly method comprises:

S1. pre-assembling: assembling a positioning axle of the electric height adjustable upright into a positioning elongated slot of a crossbeam such that the electric height adjustable upright and the crossbeam form a preassembled module, the preassembled module being folded, received, and packaged at a second position;

S2: assembling: unfolding the electric height adjustable upright to a first position, fastening the electric height adjustable upright to the first position by a fastener, and meanwhile assembling other mating members, wherein the mating members include side board frames and bottom plates.

These characteristics and advantages of the present disclosure will be disclosed in detail in the preferred embodiments below with reference to the accompanying drawings.

BRIEF DESCRIPTION OF THE DRAWINGS

Hereinafter, the present disclosure will be described in further detail with reference to the accompanying drawings.

DESCRIPTION OF THE EMBODIMENTS

Figure 1:
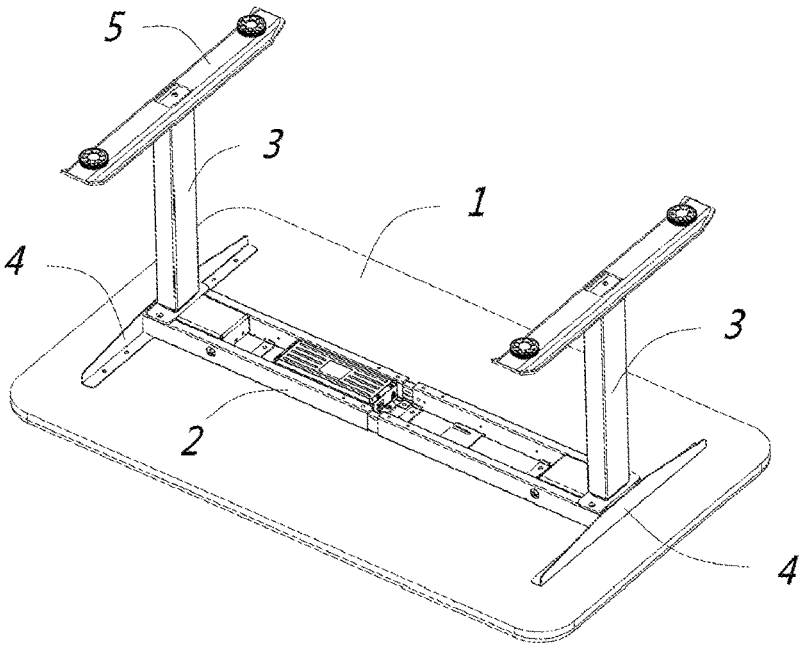
FIG. 1 is an overall structural schematic diagram of an electric height adjustable table according to Embodiment 1 of the present disclosure.
Figure 2:
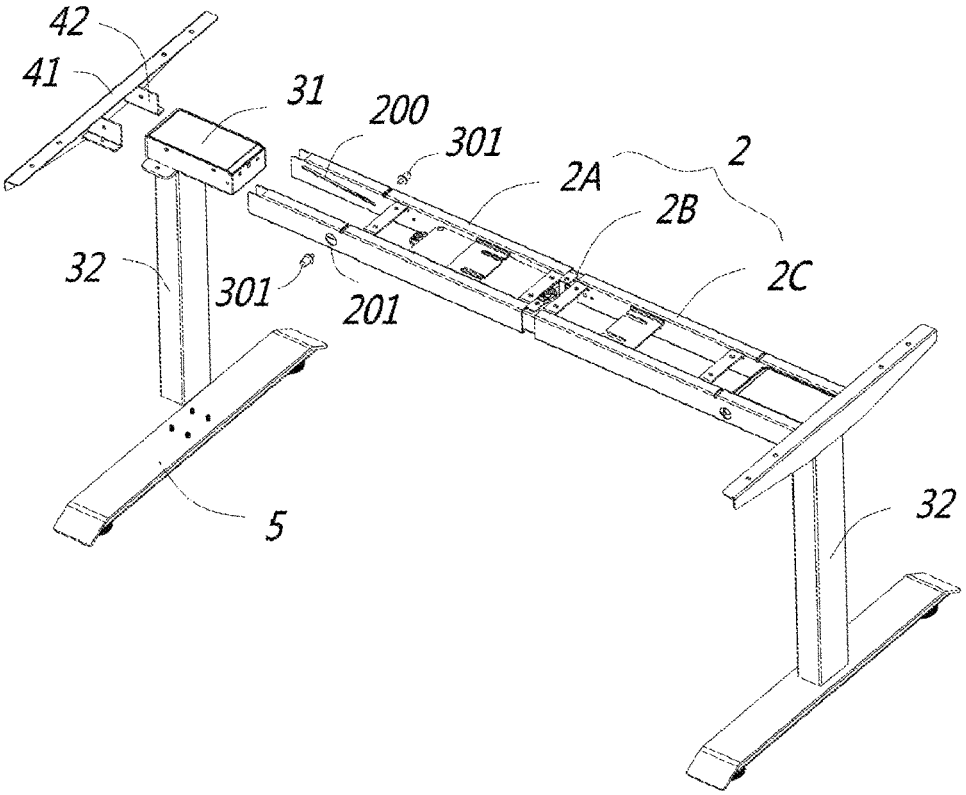
FIG. 2 is a partially explosive schematic diagram of the electric height adjustable table according to Embodiment 1 of the present disclosure.
Figure 3:
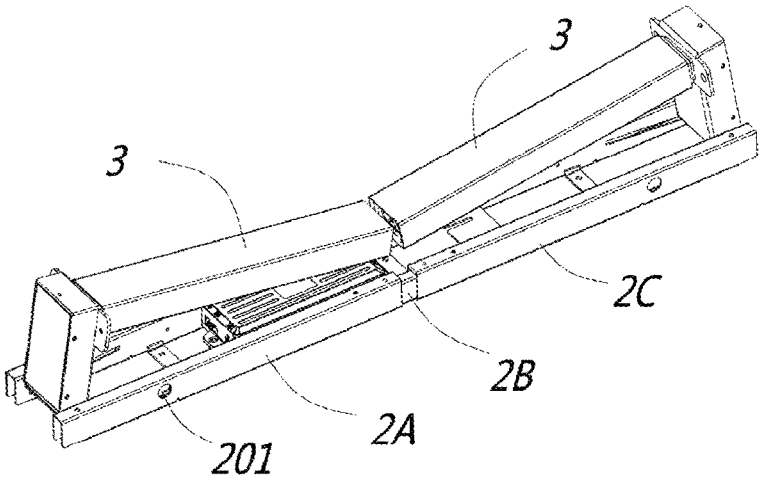
FIG. 3 is a schematic diagram of the electric height adjustable table in the second position state according to Embodiment 1 of the present disclosure.
Figure 4:
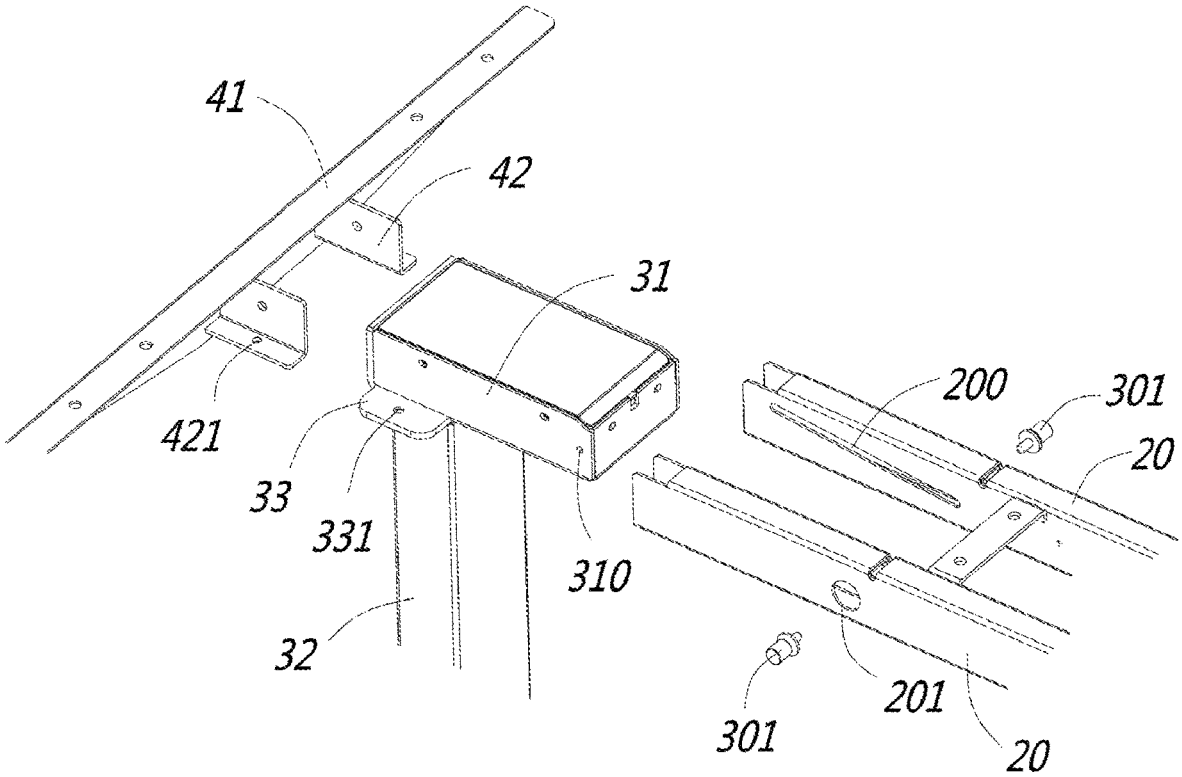
FIG. 4 is an enlarged view of the explosive part in FIG. 2.

Hereinafter, the technical solutions of the embodiments of the present disclosure will be explained and illustrated through embodiments of the present disclosure with reference to the accompanying drawings. However, the embodiments are only preferred embodiments of the present disclosure, not all of them. Other embodiments obtained by those skilled in the art without exercise of inventive work based on the examples in the embodiments all fall within the protection scope of the present disclosure.

In the description below, the orientation or position relationships indicated by the terms "inner," "outer," "upper," "lower," "left," and "right," etc. are intended only for facilitating or simplifying description of the present disclosure, not for indicating or implying that the devices or elements compulsorily possess those specific orientations and are compulsorily configured and operated with those specific orientations; therefore, they should not be understood as limitations to the present disclosure.

As shown in FIGS. 1-5, an embodiment provides an electric height adjustable folding table, comprising: a tabletop board 1 and a table stand disposed underneath the tabletop board 1, the table stand comprising a crossbeam 2, two ends of the crossbeam 2 are respectively mounted with an electric height adjustable upright 3, the electric height adjustable upright 3 being raised or lowered to drive the crossbeam 2 and the tabletop board 1 to be raised or lowered as a whole, and a bottom plate 5 is mounted to the bottom of the electric height adjustable upright 3.

In this embodiment, a positioning elongated slot 200 is provided on the crossbeam 2. In this embodiment, the length direction of the positioning elongated slot extends substantially along the transverse direction of the crossbeam 2. In one embodiment, the positioning elongated slot 200 includes a proximal end and a distal end, wherein the proximal end is proximal to the center of the crossbeam 2, and the distal end is distal to the center of the crossbeam 2. The electric height adjustable upright 3 includes a positioning axle 301, the electric height adjustable upright 3 performs a relative rotative movement and a relative sliding movement in the positioning elongated slot 200 via the positioning axle 301, such that when the electric height adjustable upright 3 is at a first position, the positioning axle 301 is at a proximal end of the positioning elongated slot 200 and maintains a spread-out angle with respect to the crossbeam 2; when the electric height adjustable upright 3 is located at a second position, the positioning axle 301 slides to the distal end of the positioning elongated slot 200, and meanwhile the positioning axle 301 rotates in the positioning elongated slot 200 towards the direction of the center of the crossbeam 2, thereby implementing folded reception.

This embodiment generates such a beneficial effect: as the positioning elongated slot 200 is provided on the crossbeam 2, the positioning axle 301 on the electric height adjustable upright 3 is oriented in the positioning slot 200, such that the positioning elongated slot 200 according to the present disclosure enables a relative rotative movement and a relative sliding movement in the positioning elongated slot 200. The relative sliding movement here mainly refers to relative sliding along the transverse direction of the crossbeam 2. The relative rotative movement is mainly configured to implement folding between the electric height adjustable upright 3 and the crossbeam 2, while the relative sliding movement is configured to move the folded electric height adjustable upright 3 to the distal end portion of the crossbeam 2 to the utmost extent, i.e., moving to the distal end of the positioning elongated slot 200, which enables the overlap portion between two folded electric height adjustable uprights 3 (i.e., at the second position) is reduced or even eliminated. In this way, the overall thickness of the folded electric height adjustable uprights is reduced, facilitating packaging and shipment.

Upon assembly, what is done by the user is rotating to unfold the electric height adjustable upright 3 and meanwhile move the positioning axle 301 of the electric height adjustable upright 3 from the distal end to the proximal end of the positioning elongated slot 200, which eliminates the trouble of repositioning and facilitates assembly.

Figure 5:
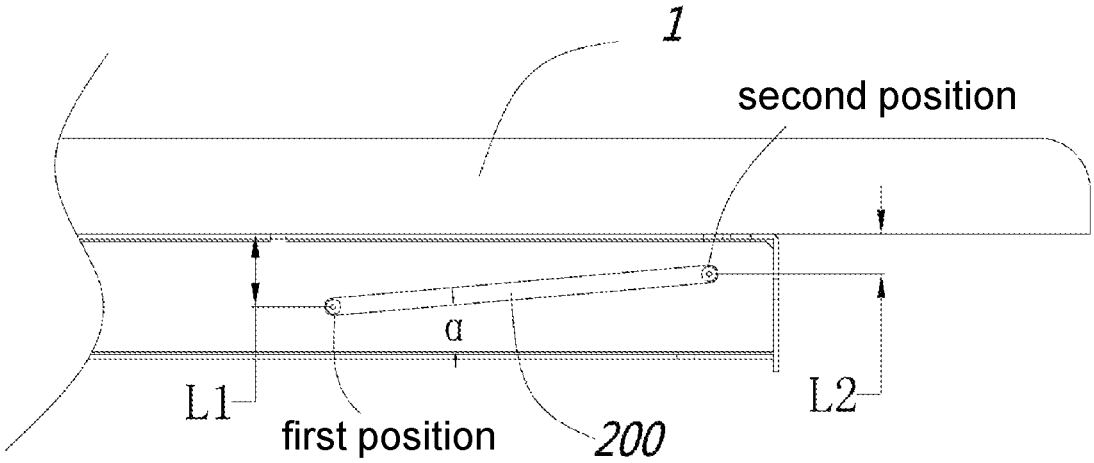
FIG. 5 is a schematic diagram of the positioning axle at different positions in the positioning elongated slot according to Embodiment 1 of the present disclosure.

To further reduce space occupation of the folded electric height adjustable upright 3, in this embodiment, the positioning elongated slot 200 is an inclined slot, the distance from its proximal end to the top of the crossbeam 2 being L1, and the distance from its distal end to the top of the crossbeam 2 being L2, wherein L1>L2, as shown in FIG. 5. This configuration enables the positioning axle 301 to not only move horizontally but also move vertically at the second position relative to the first position, causing the positioning axle 301 to be closer to the top of the crossbeam 2; accordingly, after the electric height adjustable upright 3 are folded, the overall thickness or height of the crossbeam 2 and electric height adjustable upright 3 is further reduced, thereby further reducing the space occupation and facilitating product packaging and shipment.

It is noted that the distal end of the positioning elongated slot 200 is defined relative to the proximal end, not limited to the utmost outer end of the positioning elongated slot 200, the reason of which is that in practical use, when the electric height adjustable upright 3 is completely folded, it is not always the case that the positioning axle 301 completely slides to the utmost outer end of the positioning elongated slot 200.

In an alternative embodiment, the inclined angle $\alpha$ of the positioning elongated slot 200 ranges between 1° and 45°; if the inclined angle $\alpha$ is too small, the vertical displacement variation quantity between the first position and the second position would be too small, nearly ineffective in reducing the overall thickness; if the inclined angle $\alpha$ is too large, the height of the crossbeam 2 is somewhat raised, consequently increasing costs. Therefore, the positioning elongated slot 200 is generally set in a range between 1° and 45°, preferably 5°, 10°, etc.

To ensure the stability of unfolding and reception between the electric height adjustable upright 3 and the crossbeam 2, an accommodation space for mounting the electric height adjustable upright 3 is provided in the crossbeam 2; the positioning elongated slot 200 is provided on each of the two opposite internal side walls of the accommodation space, and the positioning axle 301 is provided on each of the two opposite outer sidewalls of the electric height adjustable upright 3. Therefore, two positioning elongated slots 200 are arranged, so are the positioning axles 301; as such, a better stability is ensured when the electric height adjustable upright 3 and the crossbeam 2 have a relative movement.

In an embodiment, the electric height adjustable upright 3 is an L-shaped lift upright, comprising a housing 31 and an upright portion 32; a drive motor and a change speed gear are usually mounted in the housing 31, while a transmission lead screw and a transmission nut are included in the upright portion 32, wherein the drive motor drives, via the speed change gear, the transmission lead screw to rotate, and the transmission lead screw drives the transmission nut to move axially, thereby driving a sleeve tube of the upright portion 32 to move relatively. Such specific configurations of the height adjustable upright have been disclosed, which are not detailed here. In this embodiment, the positioning axle 301 is disposed on the relative sidewall of the housing 31.

In an embodiment, the crossbeam 2 comprises two crossbars 20 arranged in parallel, an accommodation space being formed between the two parallel crossbars 20; the housing 31 of the electric height adjustable upright 3 is exactly accommodated in the accommodation space, while the positioning elongated slot 200 is provided on the internal sidewall of the crossbar 20.

To facilitate the positioning axle 301 to be oriented in the positioning elongated slot 200, an assembly hole 201 configured for facilitating assembly of the positioning axle 301 runs between the external sidewall of the crossbar 20 and the positioning elongated slot 200, while a fixation hole 310 is provided on the external sidewall of the housing 31 of the electric height adjustable upright 3, the positioning axle 301 passing through the assembly hole 201 to be mounted to the fixation hole 310 of the housing 31.

The positioning axle 301 has a plurality of forms. In this embodiment, the positioning axle 301 is preferably a tightening screw, while the fixation hole 310 in the housing 31 is a threaded hole. Upon assembly, the housing 31 of the electric height adjustable upright 3 is first placed in the accommodation space to preliminarily align the threaded hole in the housing 31 with the assembly hole 201, and then the tightening screw passes through the assembly hole 201 and is then mounted to the threaded hole of the housing 31; upon mounting, the end of the tightening screw is not pushed dead against the crossbeam; instead, a predetermined gap is provided for relative movement between the positioning axle 301 and the positioning elongated slot 200.

It is noted that specific implementations of the positioning axle 301 are not limited to a tightening screw, which is alternatively a pin, and the fixation hole 310 in the housing 31 is a through-hole. After the fixation hole 310 is preliminarily aligned with the positioning elongated slot 200, the pin is inserted into the fixation hole 310. In an alternative embodiment, the pin and the fixation hole 310 are interference-fitted. In an alternative embodiment, the pin is an elongated pin projecting out of two outer sidewalls of the housing 31. In an alternative embodiment, two short pins are inserted into two outer sidewalls of the housing 31, respectively; alternatively, the positioning axle 301 is a protruding platform directly formed on the housing 31.

To provide a higher stability for the electric height adjustable upright 3 in the first position state, the electric height adjustable upright 3 comprises a side lug 33; when the electric height adjustable upright 3 is at the first position, the side lug 33 is fixed to the crossbeam 2 by a fastener. in this embodiment, two side lugs 33 are provided, respectively on the front and back sidewalls of the housing 31; when the electric height adjustable upright 3 is at the first position, the positioning axle 301 is disposed at the proximal end of the positioning elongated slot 200, and meanwhile, the top surface of the side lug 33 abuts against the crossbeam 2, thereby ensuring that further unfolding of the electric height adjustable upright 3 is stopped; and in this state, the side lug 33 is further fixed to the crossbeam 2 by the fastener, thereby realizing a complete fixation.

To ensure stability of the tabletop board 1, a side board frame 4 is mounted to each end of the crossbeam 2; the side board frame 4 comprises a side board 41 and a plugboard 42. In this embodiment, the crossbar 20 of the crossbeam 2 is a hollow tube 20, the plugboard 42 is inserted into the hollow tube 20; the fastener simultaneously fixes the side board 41 and the plugboard 42 to the hollow tube 20; as such, one fastener enables simultaneously fixation of the side board frame 4, the electric height adjustable upright 3, and the crossbeam 2. As to layout of hole positions, a first hole position 421 is provided on the plugboard 42, a second hole position 331 is provided on the side lug 33, and a third hole position (not shown) is provided on the crossbeam 2. When the three positions are aligned, only one fastener suffices for assembling, which is convenient for users, with less fasteners applied.

Further, in an alternative embodiment, the crossbeam 2 is a telescopic crossbeam, i.e., telescopic in the transverse direction. The telescopic structure has a plurality of implementation manners. Only one implementation manner is provided herein. The crossbeam 2 includes a left crossbeam 2A, a right crossbeam 2C, and a middle crossbeam 2B, wherein the middle crossbeam 2B has the smallest outer diameter; two ends of the middle crossbeam 2B are respectively inserted into the left crossbeam 2A and the right crossbeam 2C, like a sleeve. The telescopic crossbeam is generally configured for adjusting the length of the crossbeam 2 so as to adapt to different lengths of table board 1. An additional technical effect is achieved by fitting the telescopic crossbeam to the electric height adjustable folding upright 3. As the length or height of the electric height adjustable upright 3 has a plurality of specifications, when two electric height adjustable uprights 3 are completely folded, an overlap area still possibly exists; or, a large gap still exists between end portions of two completely folded electric height adjustable uprights. In such cases, the telescopic crossbeam enables adjustability of the interval between the two electric height adjustable uprights 3; in this way, the gap between the end portions of the two folded electric height adjustable uprights 3 is reduced as much as possible, thereby reducing the overall occupied space of the folded crossbeam 2 and electric height adjustable uprights 3.

Upon assembly, the electric height adjustable upright 3 and the crossbeam 2 form a pre-assembled module. From the user's perspective, the pre-assembled module indicates that the electric height adjustable upright 3 and the crossbeam 2 have been pre-assembled by the manufacturer or distributor when packaging or shipping the electric height adjustable table product; the pre-assembled here means that the positioning axle 301 has been assembled inside the positioning elongated slot 200, such that when the product is received, what is done by the user is just unfolding the electric height adjustable uprights 3, fastening them, and then assembling other mating members. Briefly speaking, the method of assembling the electric height adjustable table comprises:

S1. Pre-assembling: assembling a positioning axle 301 of the electric height adjustable upright 3 into a positioning elongated slot 200 of a crossbeam 2 such that the electric height adjustable upright 3 and the crossbeam 2 form a preassembled module, the preassembled module being folded, received, and packaged at a second position;

S2: assembling: unfolding the electric height adjustable upright 3 to a first position, fastening the electric height adjustable upright 3 to the first position by a fastener, and meanwhile assembling other mating members, wherein the mating members include side board frames 4 and bottom plates 5.

The pre-assembling in S1 is basically completed before packaging and shipment; the assembling in S2 is done by the user on his own after reception.

During this process, in order to further alleviate the user's assembly work, the tabletop board 1, the electric height adjustable upright 3, and the crossbeam 2 are jointly assembled into one preassembled module, i.e., the three have been fixed before packaging and shipment; as such, the user does not bother to further assemble the tabletop board 1 during step S2.

What have been described above are only preferred embodiments of the present disclosure; however, the protection scope of the present disclosure is not limited thereto. A person skilled in the art should understand that the present disclosure includes, but not limited to the contents described in the drawings and the preferred embodiments. Any modifications without departing from the functions and structural principles of the present disclosure will be included within the scope of the claims.

What is claimed is:

1. A folding table stand, comprising:

a crossbeam, disposed underneath a table board, wherein each end of the crossbeam is provided with an inclined elongated slot, and a distance from a proximal end of the inclined elongated slot to a top of the crossbeam is greater than a distance from a distal end of the inclined elongated slot to the top of the crossbeam;

two electric height adjustable uprights, respectively mounted at the ends of the crossbeam; and two positioning axles, respectively disposed in the inclined elongated slots, wherein one end of each of the electric height adjustable uprights is connected to one of the positioning axles to rotate and slide in relative to the crossbeam through the inclined elongated slot, the electric height adjustable uprights are located at a first position and maintained a spread-out angle with respect to the crossbeam when each of the positioning axles is at the proximal end of the inclined elongated slot, and the electric height adjustable uprights are located at a second position after each of the positioning axles is slid to the distal end of the inclined elongated slot and the electric height adjustable uprights are folded toward a center of the crossbeam.

2. The folding table stand according to claim 1, wherein an inclined angle of the inclined elongated slot ranges from 1° to 45°.

3. The folding table stand according to claim 1, wherein each electric height adjustable upright comprises a side lug, and when the electric height adjustable upright is at the first position, the side lug is fixed to the crossbeam.

4. The folding table stand according to claim 3, wherein the crossbeam comprises two crossbars arranged in parallel, the two crossbars are hollow tubes, end portions of each crossbar are respectively mounted with a side board frame, the side board frame comprises a side board and a plugboard, the plugboard is inserted into the corresponding hollow tube, and the side board and the plugboard are simultaneously fixed to the corresponding hollow tube.

5. The folding table stand according to claim 1, wherein the crossbeam includes an accommodation space for mounting the electric height adjustable upright, the inclined elongated slot being respectively provided on two opposite internal sidewalls of the accommodation space, and the positioning axle being respectively provided on two opposite external sidewalls of the electric height adjustable upright.

6. The folding table stand according to claim 5, wherein the crossbeam includes two crossbars arranged in parallel, the inclined elongated slot is provided on the internal sidewall of each crossbar, and an assembly hole configured for facilitating assembly of the positioning axle runs between the external sidewall of the crossbar and the inclined elongated slot.

7. The folding table stand according to claim 6, wherein the electric height adjustable upright comprises a housing and an upright portion, the positioning axle is a tightening screw mounted to the external sidewall of the housing, or the positioning axle is a pin that is plug-fitted to the housing, or the positioning axle is a protruding platform formed on the housing.

8. The folding table stand according to claim 1, wherein the crossbeam is a telescopic crossbeam.

9. The folding table stand according to claim 1, wherein the electric height adjustable upright and the crossbeam are pre-assembled to form a preassembled module.

10. The folding table stand according to claim 9, wherein the preassembled module further comprises the table board, wherein the electric height adjustable uprights and the crossbeam are fixed to the table board to jointly form the preassembled module.

11. A folding table, comprising:

the table board and the folding table stand as claimed in claim 1.

12. A method for assembling the folding table stand of claim 1, the assembly method comprising:

a pre-assembling step, comprising:

assembling the positioning axle of each of the electric height adjustable uprights into the inclined elongated slot of the crossbeam, wherein each of the positioning axles is at the distal end of the inclined elongated slot; and folding the electric height adjustable uprights toward the center of the crossbeam to the second position; and an assembling step, comprising:

unfolding the electric height adjustable uprights to the first position; and fastening the electric height adjustable uprights to the crossbeam.

13. The method for assembling the folding table stand of claim 12, wherein the assembling step further comprising mounting a side board frame to each end of the crossbeam.

14. The method for assembling the folding table stand of claim 12, wherein the assembling step further comprising mounting a bottom plate to each of the electric height adjustable uprights.

* * * * *